US006382261B1

(12) United States Patent
Raaijmakers

(10) Patent No.: US 6,382,261 B1
(45) Date of Patent: May 7, 2002

(54) LAYING RAIL STRUCTURE FOR A SERIES SHED LAYING-IN APPARATUS

(75) Inventor: Antonius Raaijmakers, Winterthur (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 09/793,302

(22) Filed: Feb. 26, 2001

(30) Foreign Application Priority Data

Mar. 24, 2000 (EP) ..... 00810254

(51) Int. Cl.[7] ..... D03D 41/00
(52) U.S. Cl. ..... 139/28
(58) Field of Search ..... 139/28

(56) References Cited

U.S. PATENT DOCUMENTS 5,188,154 A * 2/1993 Christe et al. ..... 139/28
5,431,194 A * 7/1995 Steiner et al. ..... 139/28
5,441,085 A * 8/1995 Hunziker et al. ..... 139/28
5,947,162 A * 9/1999 Steiner et al. ..... 139/28

FOREIGN PATENT DOCUMENTS

EP 0584433 A1 3/1994
EP 0612875 A1 8/1994

* cited by examiner

*Primary Examiner*—Andy Falik
(74) *Attorney, Agent, or Firm*—Townsend and Townsend and Crew LLP

(57) ABSTRACT

The laying rail (10) for a series shed weaving machine (1) comprises a plurality of cut-outs (10*a*) which are arranged with spacing for guiding warp threads (3), with each cut-out (10*a*) comprising two end sections (10*b*, 10*d*) and a guide section (10*c*) which lies between them, and with the cut-out (10*a*) having a greater width in the region of the two end sections (10*b*, 10*d*) than at the guide section (10*c*).

17 Claims, 4 Drawing Sheets

(A-A)

LAYING RAIL STRUCTURE FOR A SERIES SHED LAYING-IN APPARATUS

BACKGROUND OF THE INVENTION

The invention relates to a laying rail for series shed weaving machines and to a laying-in apparatus with laying rails.

A laying rail for laying warp threads into the weaving rotor of a series shed weaving machine is known from published European patent application EP 0 612 875 A1. This laying rail is movably mounted in the direction of extent of the weaving rotor and has a large number of cut-outs, with each warp thread extending through a cut-out and being guided thereby. The warp threads can thus be positioned with respect to the weaving rotor, i.e., to its shed forming members, through a corresponding moving of the laying rail.

A disadvantage of the known laying rail is that warp thread breakages can arise in the case of a larger thickened region in the warp thread or in the event of knots.

SUMMARY OF THE INVENTION

It is an object of the present invention to propose an economically more advantageous laying rail and a laying-in apparatus which is matched to it.

The object is satisfied by a laying rail for a series shed weaving machine, comprising a plurality of cut-outs for guiding warp threads, with each cut-out comprising two end sections and a guide section which lies between them, and with the cut-out having a greater width in the region of the two end sections than at the guide section.

As a result of the relatively wide end section of the cut-outs, the laying rail of the present invention has the advantage that a thick point in the warp thread, for example a knot, can slide relatively unhindered through the wide end section, so that no excessive forces act on the warp thread as a result of this thick point. The second wide end section of the cut-out serves for threading the warp thread into the laying rail. During normal operation the warp threads pass through the guide section which is arranged between the two end sections. This guide section has a relatively small gap width, so that the warp thread which is guided therein can be positioned very precisely through the transverse movement of the laying rail. Thus the warp threads can be very precisely laid into the shed holder means which are arranged on the weaving rotor. An essential advantage of the laying rail in accordance with the invention is also to be seen in that the warp threads can also be laid into shed holder means which have a small mutual spacing. Thus the manufacture of a cloth with a high warp thread density is possible.

The laying-in apparatus, which is designed to be matched to the laying rail, has in a preferred embodiment a separate deflection element for the warp threads. The laying rails and the deflection elements for the warp threads which are to be supplied to the laying rail are supported in a common holder, but are supported with a spatial separation from one another. The laying rails are axially movably mounted in guide supports which are formed on the holder, and the deflection elements are stationarily mounted in separate cut-outs of the holder. The deflection elements are in each case arranged above and below each group of warp threads and are manufactured of preferably low wear material or ceramics. Through this design of the laying-in apparatus, i.e. in particular as a result of the separate guide supports for the laying rails, a transfer of the heat which arises through the friction of the warp threads on the deflection elements can be kept away from the laying rails to the greatest extent. Temperature-induced length changes of the laying rails can thereby be avoided, which enables a precise holding and guiding of the warp threads by means of these laying rails. The position of the warp threads is precisely reproducible, which in turn enables the manufacture of a cloth with high warp thread density.

DETAILED DESCRIPTION OF THE PREFERRED EMBODIMENTS

Figure 1:
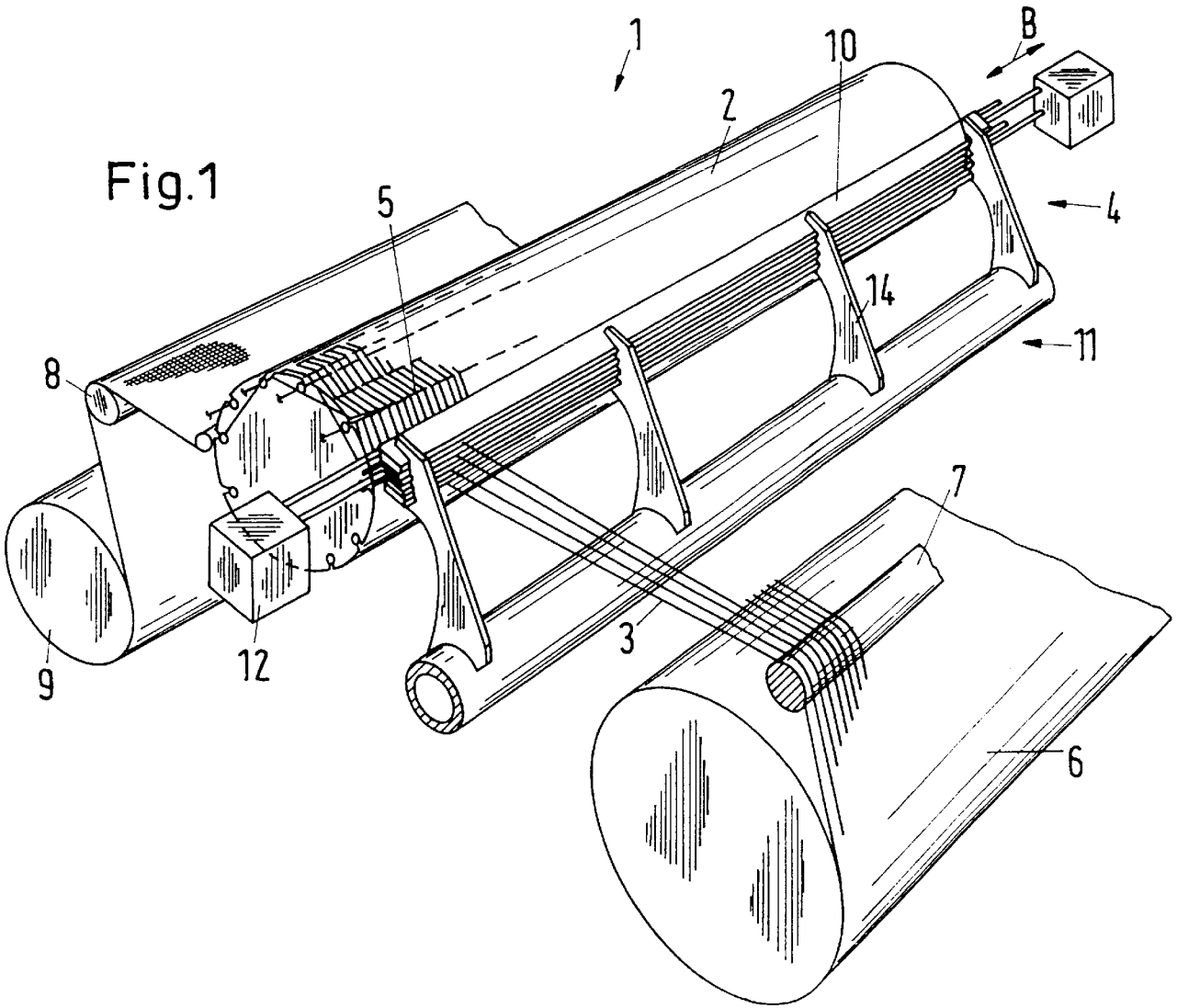
FIG. 1 is a schematic illustration of a series shed weaving machine with a laying-in apparatus and a plurality of laying rails.

FIG. 1 shows a schematically illustrated series shed weaving machine 1 comprising a weaving rotor 2, at the surface of which a large number of shed forming members 5 are arranged spaced apart alongside one another in the direction of extent of the weaving rotor 1 and form a weft insertion passage. The shed forming members 5 are arranged with spacing in the peripheral direction of the weaving rotor in such a manner that twelve weft insertion passages result for the insertion of one weft thread each. The warp threads 3, which are present on a warp beam 6, are supplied via a deflection beam 7 to the laying-in apparatus 4. The laying-in apparatus 4 comprises a holding apparatus 11 and a plurality of spaced-apart holders 14 and which displaceably mount a plurality of laying rails 10 in the direction of extent B of the weaving rotor 2. Each laying rail 10 is mechanically connected to a drive apparatus 12. The movement B of the laying rails 10 is controlled with respect to the rotational movement of the weaving rotor 2 in such a manner that the warp threads 3 are laid in into upper or lower positions of the shed forming members 5, so that a shed is formed through which the weft thread can be inserted. The warp threads are wrapped around the weaving rotor 2 over an angle of approximately 120°. The finished cloth is wound up via a breast beam 8 onto a cloth beam 9.

Figure 2:
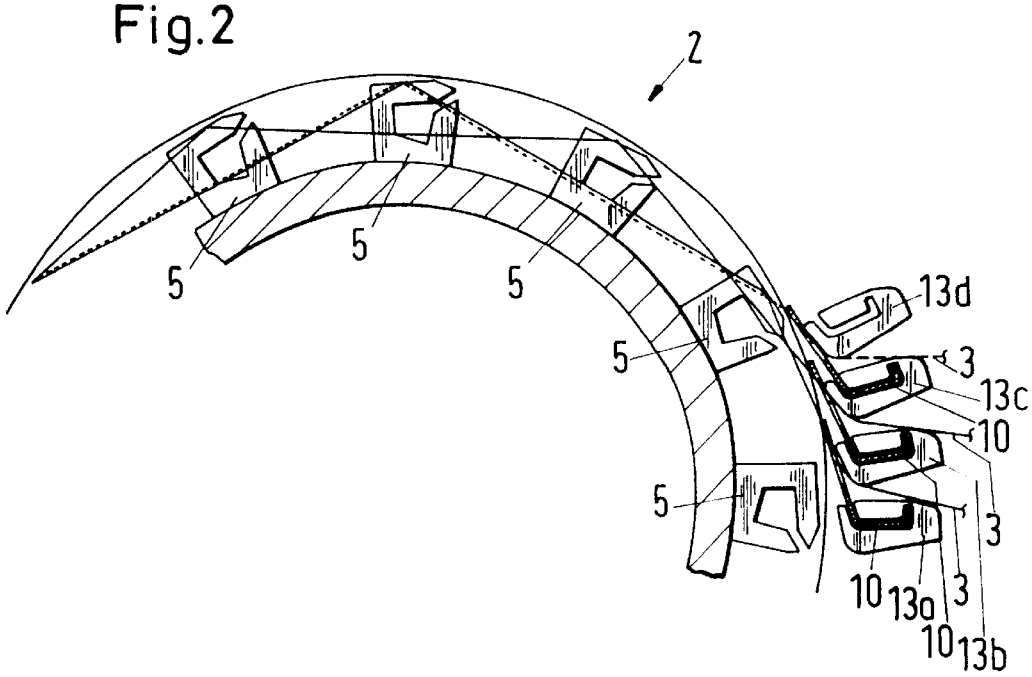
FIG. 2 is a fragmentary cross-section of the weaving rotor.

The cross-section of the weaving rotor 2 which is illustrated in FIG. 2 shows the shed forming members 5 which are arranged at its surface. On the right side the laying rails 10 are mounted in guide supports 13*a*, 13*b*, 13*c*, 13*d* and are mounted for displacement in the vertical direction with respect to the plane of view. The warp threads 3 each extend through a cut-out 10*a* of the laying rail 10 and are thereby movably guided back and forth in a direction B which is vertical with respect to the plane of view.

Figure 3:
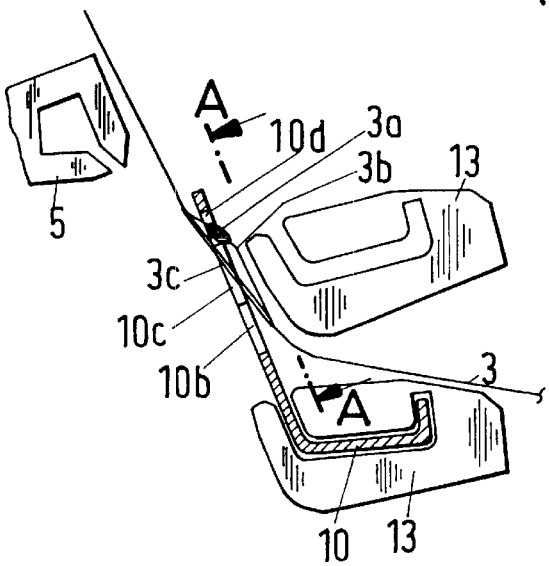
FIG. 3 is a cross-section through a laying rail and a side view of the guide support.
Figure 4:
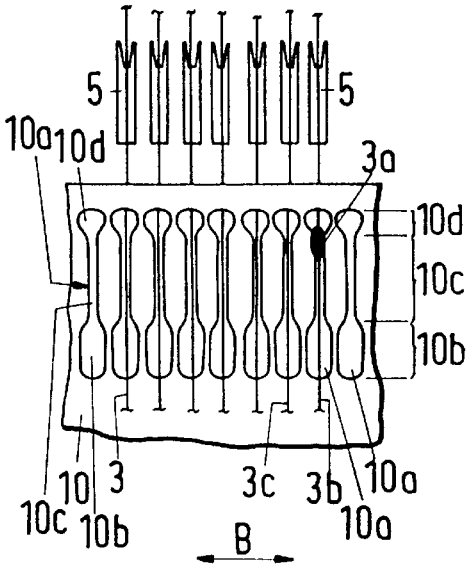
FIG. 4 is a plan view of the laying rail taken along line A—A of FIG. 3.

FIG. 3 shows the laying rail 10 with the guide support 13 in detail. FIG. 4 shows the arrangement which is illustrated in FIG. 3 in a section. The laying rail 10 has a plurality of cut-outs 10*a* or eyes 10*a* respectively which are arranged with spacing in the direction of extent of the laying rail 10 and which serve for guiding the warp threads 3. The cut-outs 10*a* are made elongate and have two end sections 10*b*, 10*d* and a guide section 10*c* which lies between them. The end section 10*b* can also be designated as a thread-in section 10*b*, which serves to thread a warp thread 3 into the cut-out 10*a*. The weaving rotor 2 and the laying-in apparatus 4 with guide supports 13 and laying rails 10 are mutually arranged and designed in such a manner that the warp thread 3 extends through the thread guide section 10*c* during a normal operation, as is illustrated by the warp thread 3*c* in FIG. 3. The thread guide section 10*c* preferably has a relatively narrow gap width, which results in the advantage that the warp threads 3 can be guided very precisely with respect to the direction of movement B of the laying rail 10 and can therefore be laid in into the shed forming members 5 very precisely. In the arrangement which is illustrated in FIG. 4 the warp threads 3 move upwards during the weaving. The warp thread 3*b* has a thickened region 3*a*. As a result of the narrow thread guide section 10*c* the knot 3*a* moves upwards along the laying rail 10 outside the guide section 10*c* and finds a passage in the relatively wide end section 10*d*, as is illustrated in FIGS. 3 and 4. The laying rail 10 in accordance with the invention thus has the advantage that it has a thread-in section 10*b* through which the warp thread 3 can be conveniently threaded in, that it has a relatively narrow thread guide section 10*c* which permits a precise guiding of the warp thread 3 and that it has a let-off section 10*d* or an end section 10*d* through which a thickened region 3*a* of the thread can pass. The warp threads 3 are thus guided through the laying rail 10 carefully and without excessive stress even in the presence of faulty locations 3*a*. Within the thread guide section 10*c* the warp thread 3 is subjected to no or to only a slight stressing. With the laying rail 10 which is designed in accordance with the invention the probability of a warp thread breakage 3 is therefore very low.

Figure 5A:
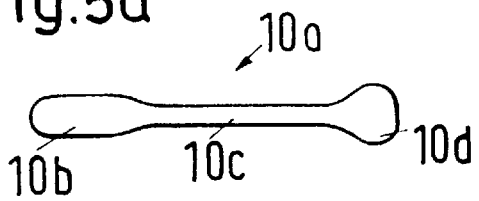
FIG. 5*a* is a plan view of the cut-out of the laying rail for guiding the warp threads.

FIG. 5*a* shows in a plan view the preferred embodiments of the cut-out 10*a*, which comprises two end sections 10*b*, 10*d* and a guide section 10*c* which lies between them, with the cut-out 10*a* having a greater width in the region of the two end sections 10*b*, 10*d* than at the guide section 10*c*.

Figure 5B:
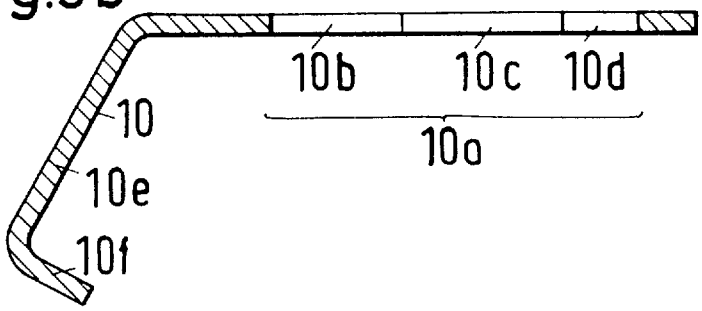
FIG. 5*b* is a cross-section of the laying rail.

FIG. 5*b* shows a cross-section through an exemplary embodiment of a laying rail 10 with the cut-out 10*a* which is illustrated in FIG. 5*a*. The laying rail 10 has a guide section 10*e*, 10*f* which is designed in U-shape or L-shape and which is mounted in a guide support 13.

Figure 6:
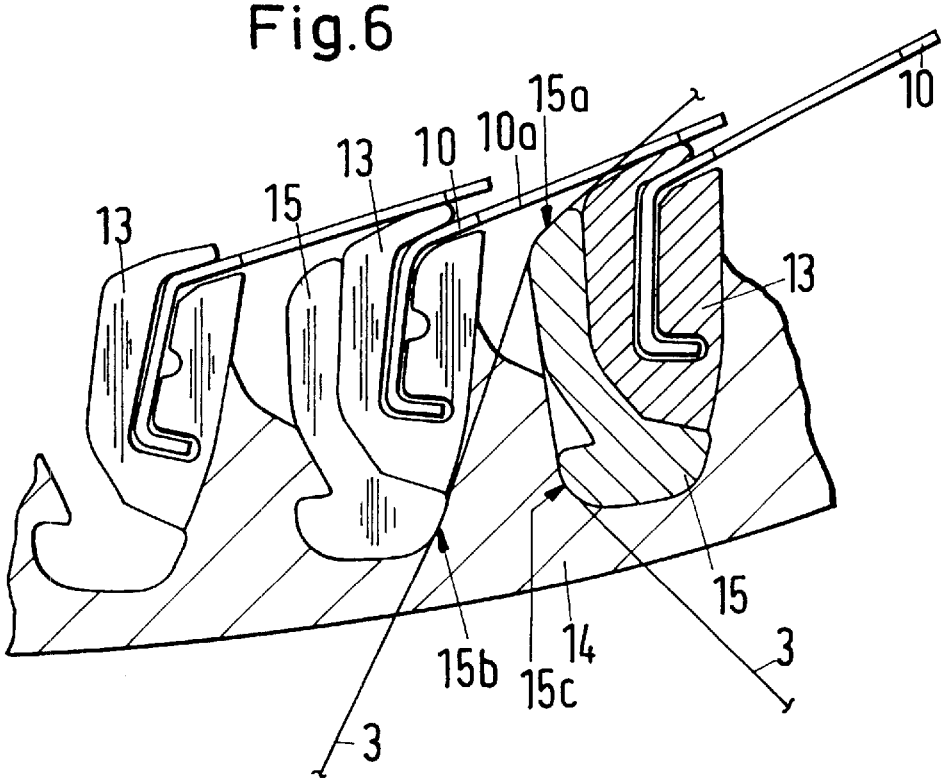
FIG. 6 is a cross-section of the laying-in apparatus.

FIG. 6 shows a cross-section through a laying-in apparatus 4 which has a plurality of guide supports 13 which are arranged with spacing for holding and guiding one laying rail 10 each. In a preferred embodiment a deflection element 15 with deflection regions 15*a*, 15*b*, 15*c* for the warp threads 3 is in each case arranged between the guide supports 13. FIG. 6 shows the warp thread 3 in two possible positions. The warp thread 3 can extend in such a manner that it:

lies in contact only at the deflection region 15*a*, lies in contact both at the deflection region 15*a* and at the deflection region 15*b*, lies in contact both at the deflection region 15*a* and at the deflection region 15*c*, In the illustrated exemplary embodiment the deflection element 15 is arranged to adjoin directly at the guide support 13. The deflection element 15 is preferably made of a low wear material such as metal or ceramics. The guide support 13 can for example be made of a plastic. Through this arrangement the frictional heat which is produced at the deflection locations 15*a*, 15*b*, 15*c* acts either hardly or not at all on the guide support 13, so that an expansion or contraction of the guide support 13 as a result of the arising temperature fluctuations is largely avoided. This permits an extremely precise guiding of the laying rail 10 in the guide support 13. Through the reduction of the influence of the heat of friction on the guide supports 13 the heat transfer to the laying rail 10 is at the same time minimized. Accordingly, length changes in the laying rails as a result of the heating at the warp thread deflection locations 15*a*, 15*b*, 15*c* do not result. The guide supports 13 are arranged in a holder 14, with it also being possible for the guide supports 13 and the respective holder 14 to be formed in a single piece. The holder 14 serves for receiving the deflection elements 15.

Figure 7:
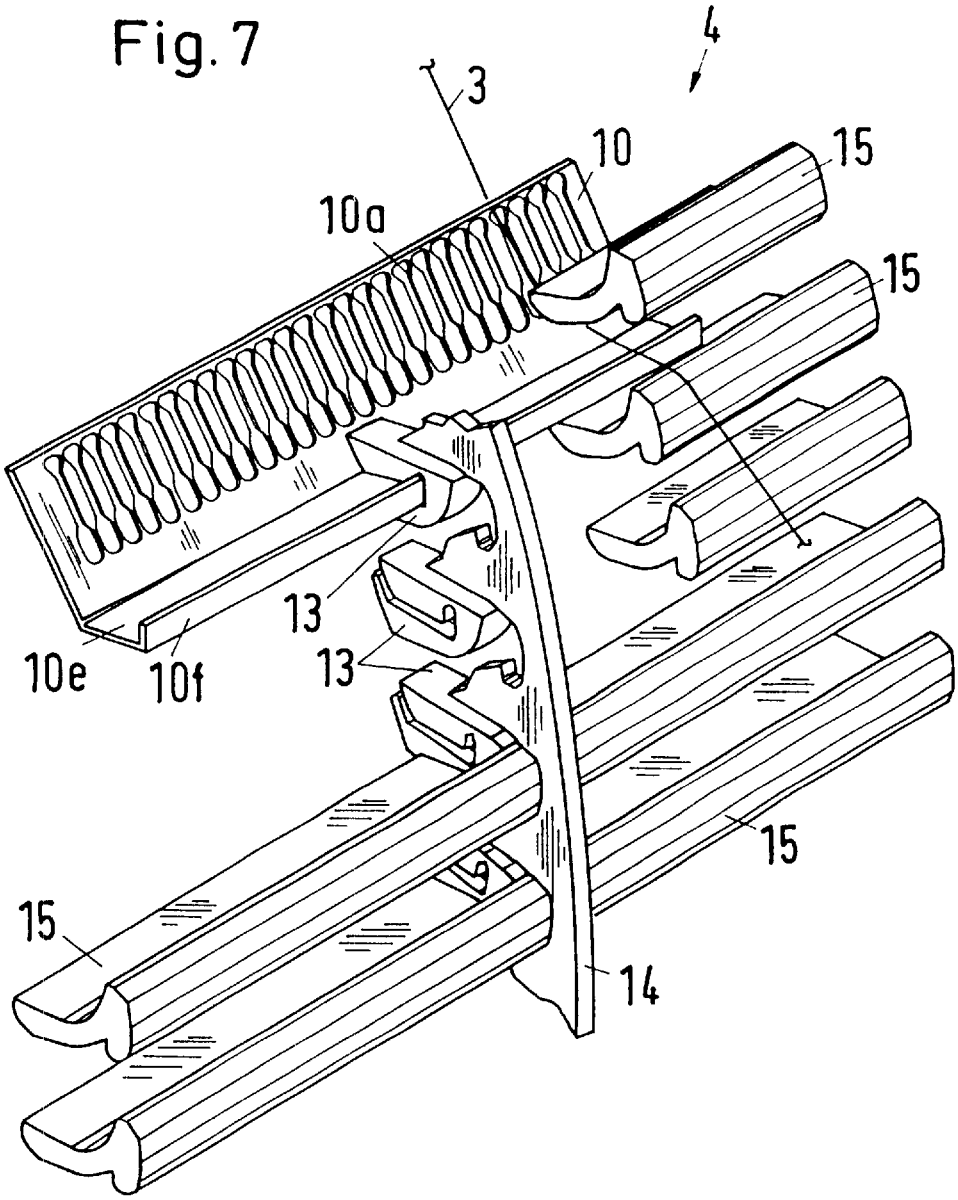
FIG. 7 is a perspective view of the laying-in apparatus.

FIG. 7 shows a perspective view of the laying-in apparatus 4. A plurality of regularly spaced deflection elements 15 are held by a holder 14. In addition, guide supports 13 of approximately 5 mm width in which the respective laying rails 10 are displaceably mounted in the direction of movement B are attached to the holder. The warp threads 3 advantageously extend in the laying-in apparatus 4 in such a manner that they have two deflection locations, as illustrated in FIG. 7, with the deflection taking place at the low wear deflection element 15.

During a normal operation of the series shed weaving machine 1 the holder 14, the deflection element 15, the laying rail 10 and the weaving rotor 2 with shed forming members 5 are arranged to be mutually matched in such a manner, and the warp threads 3 are guided in such a manner, that the warp threads 3 lie in contact in the deflection region 15*a* and extend in the thread guide section 10*c* of the laying rail 10. As soon as a warp thread 3 has a thickened region 3*a*, this warp thread 3 deviates briefly from the described normal position in that the thickened region 3*a*, as illustrated in FIGS. 3 and 4, slides along the surface of the laying rail 10 up to the passage through the let-off opening 10*d*. Then the warp thread 3 automatically jumps back into the normal position again and again extends through the guide section 10*c*.

The embodiment of a cut-out 10*a* or of an eye 10*a* respectively which is illustrated in FIG. 5*a* is to be considered only as an exemplary embodiment of a large number of embodiments having the feature that end sections 10*b*, 10*d* which have a greater gap width than the guide section 10*c* are arranged at both ends of the thread guide section 10*c*. The end sections 10*b*, 10*d* could also be designed to be circular, oval, rectangular, triangular, elliptical or to have any other geometrical shape.

In a preferred embodiment the maximum width of the end sections 10*b*, 10*d* amounts to five to ten times the maximum width of the guide section 10*c*.

The cut-outs 10*a* are preferably designed to be elongate and arranged to extend mutually parallel along the laying rail 10. The cut-outs 10*a* preferably extend perpendicular or substantially perpendicular to the longitudinal direction of the laying rail 10. As illustrated in FIG. 5 the thread-in section 10*b* can be designed to be longer than the let-off section 10*d*. In a further embodiment the thread-in section 10*b* can also have a smaller width or a greater width than the let-off section 10*d*.

What is claimed is:

1. Laying rail (10) for a series shed weaving machine (1), comprising a plurality of cut-outs (10*a*) which are arranged with spacing for guiding warp threads (3), characterized in that each cut-out (10*a*) comprises two end sections (10*b*, 10*d*) and a guide section (10*c*) which lies between them; and in that the cut-out (10*a*) has a greater width in the region of the two end sections (10*b*, 10*d*) than at the guide section (10*c*).

2. Laying rail (10) in accordance with claim 1, characterized in that a maximum width of the end sections (10*b*, 10*d*) is greater than a maximum width of the guide section (10*c*) by a factor of 5 to 10.

3. Laying rail (10) in accordance with claim 1, characterized in that the cut-outs (10*a*) are elongate and are arranged extending in a mutually parallel manner.

4. Laying rail (10) in accordance with claim 3, characterized in that the cut-outs (10*a*) extend substantially perpendicular to a longitudinal direction of the laying rail (10).

5. Laying rail (10) in accordance with claim 1, characterized in that its section along a plane which extends substantially perpendicular to a longitudinal direction of the laying rail (10) is substantially L-shaped or U-shaped.

6. Laying rail (10) in accordance with claim 1, characterized in that the one end section comprises a threading-in section (10*b*) and another end section comprises a let-off section (10*d*); in that the threading-in section (10*b*) has a greater length than the let-off section (10*d*); and/or in that the threading-in section (10*b*) has a smaller width than the let-off section (10*d*).

7. Laying-in apparatus (4) comprising a plurality of guide supports (13) which are arranged with spacing and laying rails (10) movably mounted therein in accordance with claim 1, and deflection elements (15) for deflecting the warp threads (3) being arranged between two adjacent guide supports (13).

8. Laying-in apparatus (4) in accordance with claim 7, characterized in that the deflection elements (15) extend parallel to the laying rail (10) and are arranged directly adjacent to the guide support (13).

9. Laying-in apparatus (4) in accordance with claim 7, characterized in that the laying rail (10) with the cut-out (10*a*), which is guided in a guide support (13), is arranged with respect to the adjacent guide support (13) and its deflection element (15) in such a manner that a warp thread (3) which is to be laid in extends through the cut-out (10*a*) of the laying rail (10) and over the deflection element (15) of the adjacent guide rail or of the same guide rail (13).

10. Laying-in apparatus (4) in accordance with claim 7, characterized in that the laying rail (10) and the deflection element (15) are arranged to be matched in such a manner relative to the position of a weaving rotor that the warp thread (3) extends within the thread guide section (10*c*) of the cut-out (10*a*) during normal operation of the laying-in apparatus.

11. Series shed weaving machine comprising a laying-in apparatus (4) in accordance with claim 7.

12. Series shed weaving machine comprising laying rails (10) in accordance with claim 1.

13. Laying-in apparatus for a series shed weaving machine comprising a plurality of spaced-apart guide supports, laying rails movably mounted to the guide supports, the laying rails having a plurality of spaced-apart cut-outs for guiding warp threads, each cut-out comprising first and second end sections and a guide section between the end sections; the end sections of the cut-out having a greater width than the guide section of the cut-out, and deflection elements for deflecting the warp threads and located between adjacent guide supports.

14. Laying-in apparatus in accordance with claim 13, wherein the deflection elements extend parallel to the laying rail and are arranged directly adjacent to the guide support.

15. Laying-in apparatus in accordance with claim 13, wherein the laying rail with the cut-outs is guided in a guide support and arranged with respect to the adjacent guide support and its deflection element in such a manner that a warp thread which is to be laid in extends through one of the cut-outs of the laying rail and over the deflection element of one of the adjacent guide rail and the same guide rail.

16. Laying-in apparatus in accordance with claim 13, wherein the laying rail and the deflection element are arranged to be matched in such a manner relative to the position of a weaving rotor that the warp thread extends through the guide section of the cut-out during normal operation of the laying-in apparatus.

17. Series shed weaving machine comprising laying rails each having a plurality of spaced-apart cut-outs for guiding warp threads, each cut-out comprising first and second end sections and a guide section between the end sections; the end sections of the cut-out having a greater width than the guide section of the cut-out, and deflection elements for deflecting the warp threads and located between adjacent guide supports.

* * * * *